US006427266B2

(12) United States Patent
Talley-Williams

(10) Patent No.: US 6,427,266 B2
(45) Date of Patent: Aug. 6, 2002

(54) BEDDING ENSEMBLE

(76) Inventor: Kelli C. Talley-Williams, 3936 E. Park Blvd., Plano, TX (US) 75074

( * ) Notice: Subject to any disclaimer, the term of this patent is extended or adjusted under 35 U.S.C. 154(b) by 0 days.

(21) Appl. No.: 09/741,775

(22) Filed: Dec. 19, 2000

Related U.S. Application Data

(60) Provisional application No. 60/173,122, filed on Dec. 27, 1999.

(51) Int. Cl.[7] ..... A47G 9/02

(52) U.S. Cl. ..... 5/482; 5/494; 5/491; 5/497; 5/502

(58) Field of Search ..... 5/482, 494, 496, 5/497, 448, 501, 502

(56) References Cited

U.S. PATENT DOCUMENTS

| | | | | | |
|---|---|---|---|---|---|
| 3,008,152 | A | * | 11/1961 | Seidenberg | 5/501 |
| 3,530,487 | A | * | 9/1970 | Beer | 5/494 |
| 4,339,835 | A | * | 7/1982 | Jaffe et al. | 5/502 |
| 4,546,508 | A | * | 10/1985 | Ison | 5/502 |
| 6,044,503 | A | * | 4/2000 | McClendon | 5/497 |
| 6,098,219 | A | * | 8/2000 | Milber | 5/502 |

FOREIGN PATENT DOCUMENTS

| | | | | | |
|---|---|---|---|---|---|
| GB | 002273870 | A | * | 7/1994 | 5/497 |

* cited by examiner

*Primary Examiner*—Michael F. Trettel
(74) *Attorney, Agent, or Firm*—April M. Mosby

(57) ABSTRACT

A bedding ensemble including a fitted sheet portion, a flat sheet portion and a comforter portion that eliminates a number of the steps necessary to make a bed is disclosed herein. This non-binding solution provides the fitted sheet portion which overlies a mattress. The flat sheet portion covers the fitted sheet portion, coupling to a right side, a left side and a lower end of the fitted sheet portion. The comforter portion overlies the flat sheet portion and couples to a lower end, a right side and a left side of the flat sheet portion. The comforter portion, the flat sheet portion, and the fitted sheet portion securely couple at a predetermined position between the head end and the foot end to form a opening between each portion for free and easy movement of the flat sheet portion and the comforter portion away from the fitted sheet portion.

The comforter and flat sheet portions are thus easily raised or pushed toward the rear of the bed without resistance since they are coupled at a predetermined position between the foot end and the head end. This bed ensemble accommodates such movements without binding. Proper positioning of the bedding ensemble is easily accomplished by simply laterally moving the comforter and flat sheet portions to a position where the comforter portion is even on both sides. Finally, a bed skirt may be connected to the fitted sheet portion providing an attractive finished appearance of the bed when made.

11 Claims, 2 Drawing Sheets

BEDDING ENSEMBLE

This appl. claims benefit of Prov. No. 60/173,122 filed Dec. 27, 1999.

FIELD OF THE INVENTION

This invention relates generally to bedding and, in particular, to a bedding ensemble.

BACKGROUND OF THE INVENTION

The general procedure for making the bed consists of placing a fitted sheet on the mattress and assembling a flat sheet over the mattress. The next step provides for tucking in the corners of the flat sheet and sides, leaving an opening to the top of the mattress. The comforter or bedspread is placed atop the flat sheet to fully cover the bed. Comforters, bedspreads, quilts and the like are used to trap air around the body of a sleeper, providing heat to the sleeper. These also protect other bedding from soil as well as serve a decorative purpose. The process of assembling the fitted sheet, the flat sheet and the comforter to the mattress is tedious and a bit cumbersome.

A known bed covering including a fitted sheet portion disclosed in U.S. Pat. No. 4,402,098 is incorporated by reference herein. The fitted sheet portion of the bed covering overlies a separate fitted sheet that is in overlying relation with a mattress. The fitted sheet portion of the bed covering includes an elasticized upper edge portion which defines a central opening. This central opening exposes the underlying fitted sheet or other bed linen on which one is supported when sleeping on the bed. The underlying fitted sheet and the fitted sheet portion of the bed covering are not coupled together. Accordingly, this central opening is binding and does not enable sufficient freedom of movement during sleeping since the sides and the foot end of the flat sheet and fitted sheet are at all times bounded by this central opening. Another disadvantage of this design is that the separate fitted sheet must be supplied. Otherwise, the bed covering disclosed only has a single bottom sheet and a single top sheet.

Therefore, there is a need for a non-confining bedding ensemble that includes a fitted sheet portion, a flat sheet portion and a comforter portion which eliminates a portion, if not most, of the number of the steps for the process of making the bed.

SUMMARY OF THE INVENTION

A bedding ensemble including a fitted sheet portion, a flat sheet portion and a comforter portion eliminates a number of the steps necessary to make a bed. This nonbinding solution provides that the fitted sheet portion which overlies a head end, a foot end, a left side and a right side of a mattress. The flat sheet portion covers the fitted sheet portion, coupling to a right side, a left side and a lower end of the fitted sheet portion. The comforter portion overlies the flat sheet portion and couples to the lower end, the right side and the left side of the flat sheet portion. The comforter portion, the flat sheet portion and the fitted sheet portion securely couple at a predetermined position between the head end and the foot end to form a opening between each portion for free and easy movement of the flat sheet portion and the comforter portion away from the fitted sheet portion.

The comforter and flat sheet portions are thus easily raised or pushed toward the rear of the bed without resistance since they are coupled at a predetermined position between the foot end and the head end. This bed ensemble accommodates such movements without binding. Proper positioning of the bedding ensemble is easily accomplished by simply laterally moving the comforter and flat sheet portions to a position where the comforter portion is even on both sides. Finally, a bed skirt may be connected to the fitted sheet portion providing an attractive finished appearance of the bed when made.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF PREFERRED EMBODIMENTS

Figure 1:
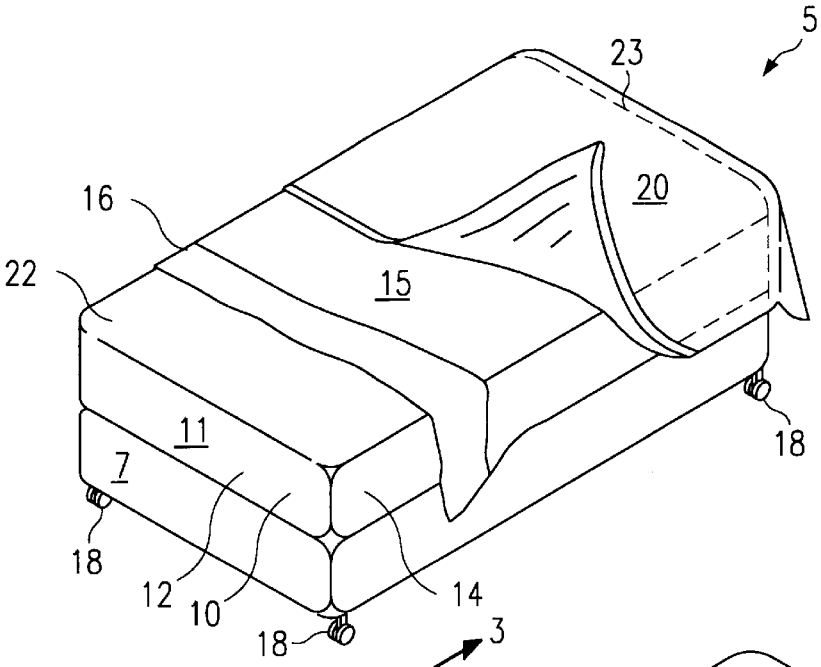
FIG. 1 is a perspective view showing the open forward end of the bedding ensemble in accordance with the present invention raised to show the lateral construction thereof.

A bedding ensemble 5 in accordance with the present invention is shown in FIG. 1. The ensemble 5 is fitted over a conventional bed including a mattress 11, a box spring 7 and a plurality of legs 18 or other frame means for supporting the box spring in clearance relation from the floor surface.

The mattress 11 has a head end 12, a foot end 23, opposite sides 14 and 16, a top surface 22 and a bottom surface (not shown).

The bedding ensemble 5 includes a fitted sheet portion 10, which is adapted to overlie the head end 12, foot end 23 and sides 14 and 16 of mattress 11. A peripheral elasticized lower edge portion (not shown) of the fitted sheet portion 10 tucks in along the bottom surface of the mattress 11 for securely fitting the bedding ensemble thereon.

A flat sheet portion 15 which is adapted to overlie the fitted sheet portion 10. The flat sheet portion couples to the fitted sheet portion 10 at the foot end 23 and sides 14 and 16. At the head end 12, the flat sheet portion placement may be in overlying relation to the fitted sheet portion or may be folded down for ascetic effect.

A comforter portion 20 is adapted to overlie the flat sheet portion 15. The comforter portion 20 couples to the flat sheet portion at the foot end 23 and sides 14 and 16. The comforter portion 20 may be any type of comforter such as a warm bed covering, a bedspread, a quilt or the like. In the alternative, the comforter portion 20 can be a flat sheet.

Figure 2:
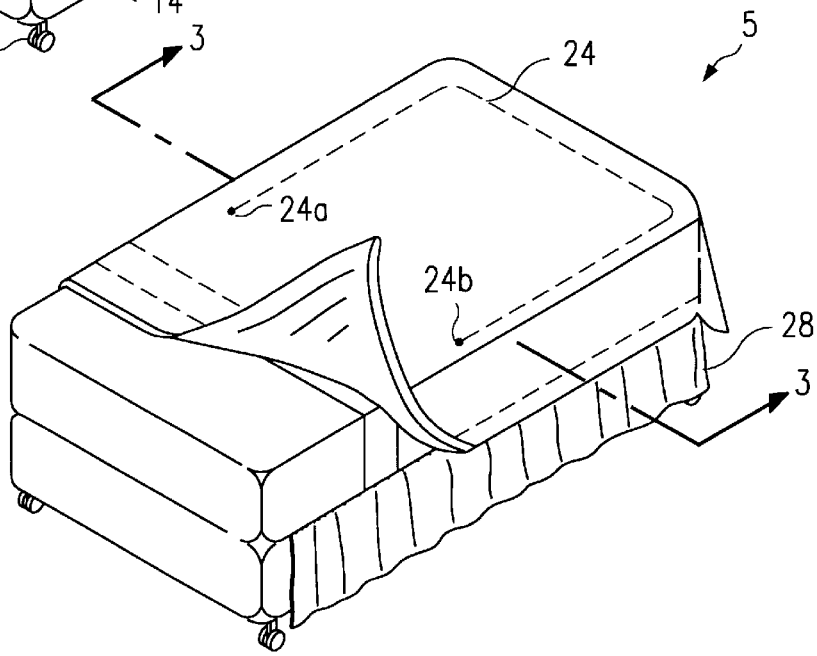
FIG. 2 is a perspective view showing the open forward end of the bedding ensemble with an attached skirt in accordance with the present invention raised to show the lateral construction thereof.

FIG. 2 shows another embodiment which further includes a bed skirt portion 28 attached to the fitted sheet portion at the sides 14 and 16 and the foot end 18. As shown in FIG. 2, along line 24, the comforter portion 20, the fitted sheet portion 10 and the flat sheet portion 15 are coupled together. The stitching indicated at 24 which outlines the comforter portion 20 is provided both for aesthetic effect and for facilitating great freedom of movement. The ends 24*a* and 24*b* of stitching 24 indicate a predetermined position where the stitching stops. This predetermined position is between the head end 12 and the foot end 23. This predetermined position may be midway between the head end 12 and the foot end 23 but is not limited to this particular dimension. Thus, it is seen that the comforter portion 20 and the flat sheet portion 15 can be easily raised up and down relative to the mattress 11 and even moved back and forth and side to side to a substantial extent without binding the person positioned in the bedding ensemble 5. Thereby, greatly facilitating entry onto and exit from a bed equipped with the bedding ensemble 5 of the present invention.

Figure 3:
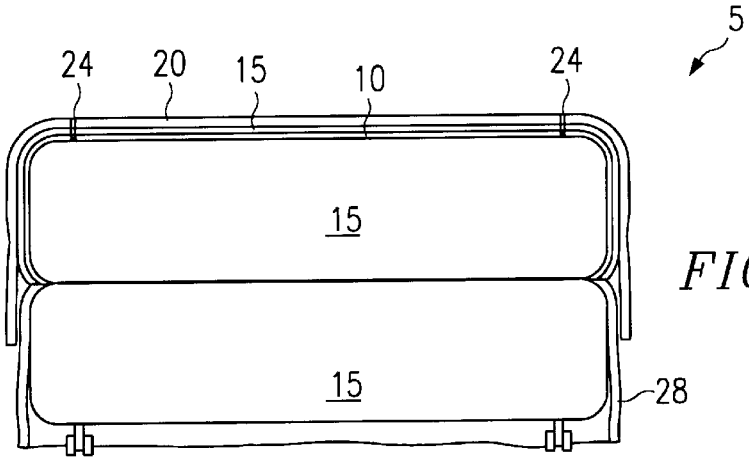
FIG. 3 is a sectional view showing the construction of the bedding ensemble in accordance with the present invention.

FIG. 3 shows the cross-sectional view along line 3 in FIG. 2 of the bedding ensemble 5. As shown stitching along line 24 attaches the comforter portion 20, the flat sheet portion 15, and the fitted sheet portion 10 securely together.

Figure 4:
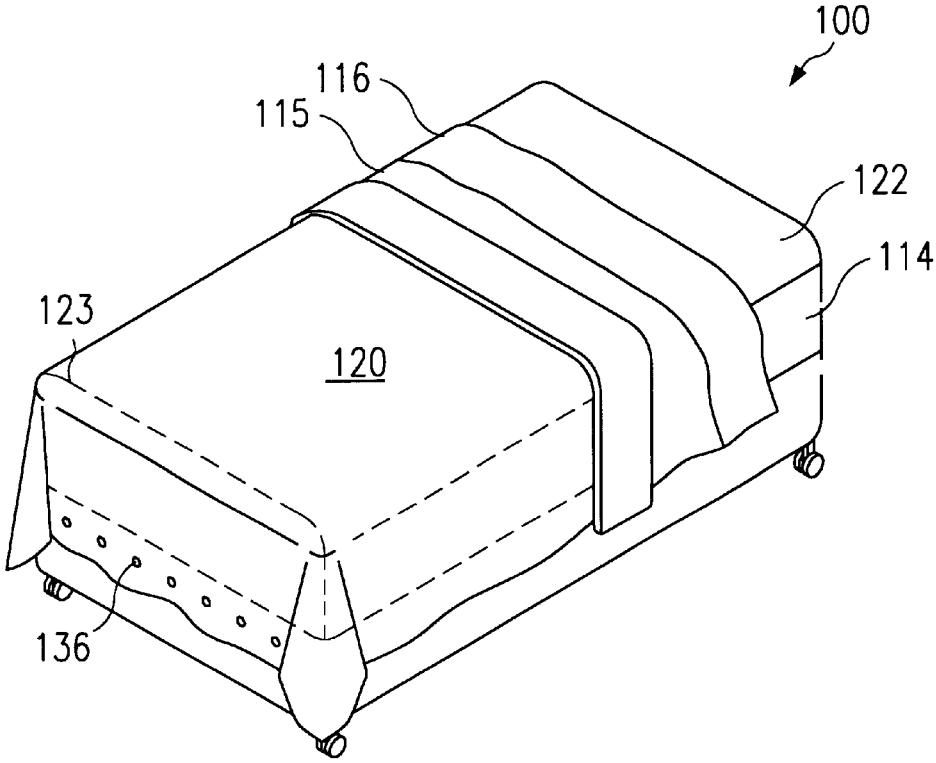
FIG. 4 is a perspective view showing the open forward end of the bedding ensemble in accordance with another embodiment of the present invention raised to show the lateral construction thereof.

A second embodiment, bedding ensemble 100, illustrated in FIG. 4, includes a fitted sheet portion 110, which is adapted to overlie the head end 112, foot end 123 and sides 114 and 116 of mattress 111. A peripheral elasticized lower edge portion (not shown) of the fitted sheet portion 110 tucks in along the bottom surface of the mattress 111 for securely fitting the bedding ensemble thereon.

A flat sheet portion 115 which is adapted to overlie the fitted sheet portion 110. The flat sheet portion couples to the fitted sheet portion 110 at the foot end 123 and sides 114 and 116. At the head end 112, the flat sheet portion placement may be in overlying relation to the fitted sheet portion or may be folded down for ascetic effect.

Figure 5:
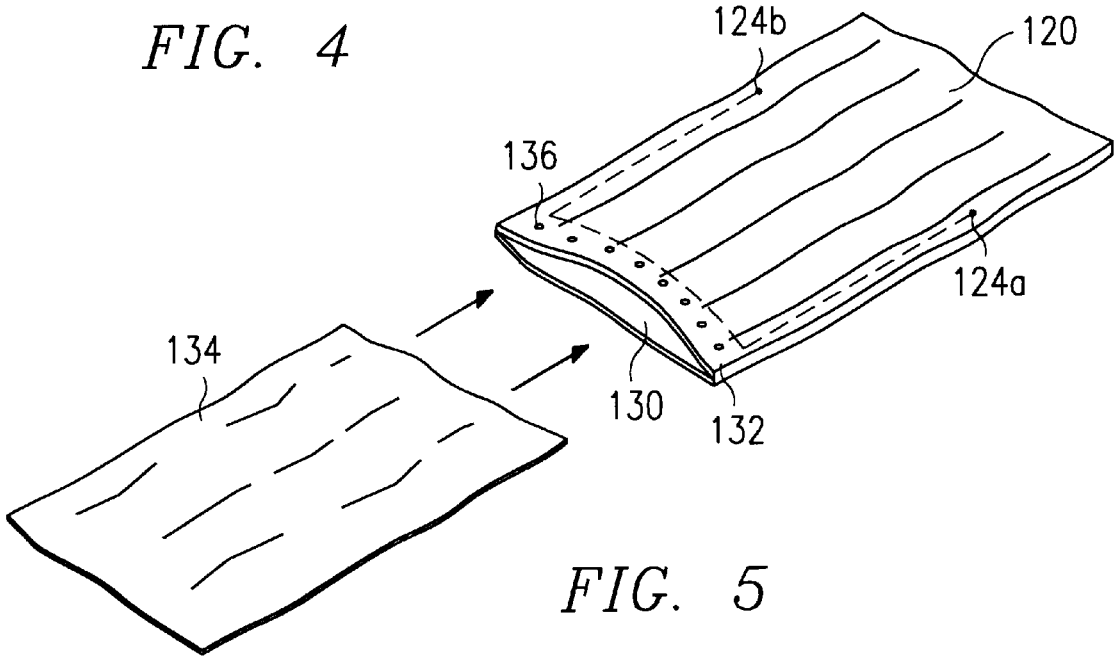
FIG. 5 is a perspective view showing the open foot end of the pocket portion of the bedding ensemble in accordance with the embodiment disclosed in FIG. 4.

A pocket portion 120 is adapted to overlie the flat sheet portion 115. The pocket portion 120 couples to the flat sheet portion 115 at the foot end 123 and sides 114 and 116. Specifically, in FIG. 5, the pocket portion 120 includes a first and a second sheet, 130 and 132, coupled along the head end 112 and sides 114 and 116. The first and second sheet, 130 and 132, couple to form a pocket for placement of a comforter 134. The foot end 123 of the first and second sheet, 130 and 132, may couple together using either a plurality of disengageable members 136, such as zippers, snaps, glue, VELCRO™, or other disengageable and fixed fastening means, whereby the comforter 134 is easily placed in or removed from the pocket portion 120. The insertion or removal of the comforter 134 inside the pocket portion 120 allows for variation in thickness and type of the comforter 134 to coincide with the change in the temperature due to seasonal change. This embodiment is also advantageous because it allows for easy laundering of both the bedding ensemble 100 and the comforter 134 separately. Moreover, the comforter 134 may be an electric blanket, providing further comfort to the sleeper. The stitching indicated at 124 which outlines the pocket portion 120 is provided both for aesthetic effect and for facilitating great freedom of movement. The ends 124*a* and 124*b* of stitching 124 indicate a predetermined position where the stitching stops. Note, however in this embodiment the stitching 124 at the foot end 123 only attaches the first sheet 130 of the pocket portion 120 to the flat sheet portion 115 and the fitted sheet portion 110. This predetermined position is between the head end 112 and the foot end 123. This predetermined position may be midway between the head end 112 and the foot end 123 but is not limited to this particular dimension.

Moreover, it is apparent that most all of the stitched or sewn connections in the various embodiments could be replace by zippers, snaps, glue, VELCRO™, or other disengageable and fixed fastening means if preferred. Generally, the sewn seams are preferred as a light weight permanent fastening means which best eliminates drafts. A zipper or the like may be advantageous for the connection between the skirt and fitted side covering, however, for easier entry onto and exit from a bed provided with the bedding ensemble 5 of the invention.

Those skilled in the art to which the invention relates will appreciate that various substitutions, modifications and additions can be made to the described embodiments, without departing from the spirit and scope of the invention as defined by the claims.

What is claimed is:

1. A bedding ensemble for a mattress having a head end and a foot end, a right and a left side and a top surface, the bedding ensemble comprising:

a fitted sheet portion adapted to overlie the head end, the foot end, and the left and right sides of the mattress; the fitted sheet portion having a fitted upper end, a fitted lower end, a left and a right fitted side;

a flat sheet portion sized to cover the fitted sheet portion, the flat sheet portion coupled to the right side, the left side, and the lower end of the fitted sheet portion;

a comforter portion adapted to overlie the flat sheet portion, the comforter portion coupled to the right side, the left side, and the lower end of the flat sheet portion; and a securing means coupled to the comforter portion, the flat sheet portion, and the fitted sheet portion at a predetermined position between the head end and the foot end to form a opening between each portion for free and easy movement of the flat sheet portion and the comforter portion away from the fitted sheet portion, the securing means is thread.

2. The bedding ensemble of claim 1, wherein the comforter portion is a flat sheet.

3. The bedding ensemble of claim 1 further comprising a skirt portion attached to the fitted sheet portion along the upper and lower ends and the left and right sides.

4. A bedding ensemble for a mattress having a head end and a foot end, a right and a left side and a top surface, the bedding ensemble comprising:

a fitted sheet portion adapted to overlie the head end, the foot end, and the left and right sides of the mattress, the fitted sheet portion having a fitted upper end, a fitted lower end, a left and a right fitted side;

a flat sheet portion sized to cover the fitted sheet portion, the flat sheet portion coupled to the right side, the left side, and the lower end of the fitted sheet portion; and a pocket portion having a first sheet and a second sheet, the first and second sheet each having an upper end, a lower end, a left and a right side, the left side of the first sheet coupled to the left side of the second sheet, the right side of the first sheet coupled to the right side of the second sheet, the upper end of the first sheet coupled to the upper end of the second sheet, the lower end of each first sheet disengageably coupled to the lower end of the second sheet, the pocket portion adapted to overlie the flat sheet portion, the pocket portion coupled to the right side, the left side, and the lower end of the flat sheet portion;

a securing means coupled to the pocket portion, the flat sheet portion, and the fitted sheet portion at a predetermined position between the head end and the foot end to form a opening between each portion for free and easy movement of the flat sheet portion and the pocket portion away from the fitted sheet portion.

5. The bedding ensemble of claim 4, further comprising a disengageable comforter for placement inside the pocket portion.

6. The bedding ensemble of claim 4, wherein the securing means is a plurality of fastening members.

7. The bedding ensemble of claim 4, wherein the securing means is a zipper.

8. A bedding ensemble for a mattress having a head end and a foot end, a right and a left side and a top surface, the bedding ensemble comprising:

a fitted sheet portion adapted to overlie the head end, the foot end, and the left and right sides of the mattress; the fitted sheet portion having a fitted upper end, a fitted lower end, a left and a right fitted side;

a flat sheet portion sized to cover the fitted sheet portion, the flat sheet portion coupled to the right side, the left side, and the lower end of the fitted sheet portion; and a pocket portion having a first sheet and a second sheet, the first and second sheet each having an upper end, a lower end, a left and a right side, the left side of the first sheet coupled to the left side of the second sheet, the right side of the first sheet coupled to the right side of the second sheet, the lower end of the first sheet coupled to the lower end of the second sheet, the upper end of each first sheet disengageably coupled to the upper end of the second sheet, the pocket portion adapted to overlie the flat sheet portion, the pocket portion coupled to the right side, the left side, and the upper end of the flat sheet portion; and a securing means coupled to the pocket portion, the flat sheet portion, and the fitted sheet portion at a predetermined position between the head end and the foot end to form a opening between each portion for free and easy movement of the flat sheet portion and the pocket portion away from the fitted sheet portion.

9. The bedding ensemble of claim 8 further comprising a disengageable comforter for placement inside the pocket portion.

10. The bedding ensemble of claim 8, wherein the securing means is a plurality of fastening members.

11. The bedding ensemble of claim 8, wherein the securing means is a zipper.

* * * * *